US010883268B2

(12) United States Patent
Jang

(10) Patent No.: US 10,883,268 B2
(45) Date of Patent: Jan. 5, 2021

(54) HOLLOW BRICK WITH FOOT PORTIONS

(71) Applicant: Kuan-Chih Jang, Kaohsiung (TW)

(72) Inventor: Kuan-Chih Jang, Kaohsiung (TW)

( * ) Notice: Subject to any disclaimer, the term of this patent is extended or adjusted under 35 U.S.C. 154(b) by 0 days.

(21) Appl. No.: 16/554,852

(22) Filed: Aug. 29, 2019

(65) Prior Publication Data

US 2020/0190808 A1 Jun. 18, 2020

(30) Foreign Application Priority Data

Dec. 18, 2018 (TW) ..... 107145721 A

(51) Int. Cl.
*E04B 2/42* (2006.01)
*E04D 13/16* (2006.01)

(52) U.S. Cl.
CPC ..... *E04B 2/42* (2013.01); *E04D 13/1681* (2013.01); *E04D 13/1687* (2013.01); *E04D 13/1662* (2013.01)

(58) Field of Classification Search
CPC ..... E04D 13/1681; E04D 13/1687; E04D 13/1662; E04C 1/24; E04B 2/42; E04B 2002/0215
See application file for complete search history.

(56) References Cited

U.S. PATENT DOCUMENTS 1,451,340 A * 4/1923 Kroonen ..... E04B 2/42 52/429
1,481,249 A * 1/1924 Beinecke ..... E04B 2/42 52/505
1,524,612 A 1/1925 Anderson
1,720,306 A * 7/1929 Tremper ..... E04B 2/20 138/115
2,074,592 A 3/1937 Rowell
2,126,394 A 8/1938 Henry
2,198,688 A * 4/1940 Williamson ..... E04B 2/42 138/115
2,199,946 A * 5/1940 Barnhart ..... E04C 1/41 52/310

(Continued)

FOREIGN PATENT DOCUMENTS

CN 1293295 A 5/2001
CN 1936233 A 3/2007

(Continued)

OTHER PUBLICATIONS

Taiwan Patent Office, "Search Report appended to an Office Action", which was issued to Taiwanese counterpart application No. 107145721, document of 2 pages, dated Nov. 27, 2019.

(Continued)

*Primary Examiner* — Rodney Mintz
(74) *Attorney, Agent, or Firm* — Akerman LLP; Peter A. Chiabotti

(57) ABSTRACT

A hollow brick includes a bottom wall, two side walls projecting from the bottom wall, a plurality of intermediate walls projecting from the bottom wall between the side walls, a top wall opposite to the bottom wall and connecting the side walls and the intermediate walls, and a plurality of ventilation holes bounded by the bottom wall, the side walls, the intermediate walls and the top wall. The bottom wall has a plurality of foot portions projecting downwardly and spaced apart from each other. A bottom groove is formed between two adjacent ones of the foot portions.

6 Claims, 6 Drawing Sheets

(56) References Cited

U.S. PATENT DOCUMENTS

| | | | | | |
|---|---|---|---|---|---|
| 2,451,392 | A * | 10/1948 | Kennedy | C21B 9/06 | 165/9.1 |
| 2,552,712 | A * | 5/1951 | Ellis | E04B 2/14 | 52/274 |
| 3,220,715 | A * | 11/1965 | Kinney | C21B 9/06 | 165/9.4 |
| 3,461,631 | A * | 8/1969 | Brugnola | E04B 2/18 | 52/606 |
| 4,058,948 | A * | 11/1977 | Warren | E04C 1/41 | 52/405.1 |
| 4,485,604 | A | 12/1984 | Palamara et al. | | |
| 4,535,579 | A | 8/1985 | Burgoyne et al. | | |
| 4,601,150 | A * | 7/1986 | Dougherty | E04B 7/22 | 404/18 |
| 4,698,949 | A * | 10/1987 | Dietrich | E04B 2/44 | 52/415 |
| 5,410,848 | A | 5/1995 | McClinton et al. | | |
| 5,575,128 | A | 11/1996 | Haener | | |
| 5,715,635 | A * | 2/1998 | Sherwood | E04B 2/16 | 52/286 |
| 6,280,121 | B1 * | 8/2001 | Khamis | E02D 29/0225 | 405/284 |
| 6,889,479 | B2 * | 5/2005 | Thorpe | E04B 2/18 | 52/596 |
| 7,775,747 | B2 * | 8/2010 | Bott | E02D 29/025 | 405/284 |
| 8,132,988 | B2 * | 3/2012 | Dawson | B28B 7/241 | 405/286 |
| 9,038,346 | B1 | 5/2015 | Wauhop | | |
| 9,863,145 | B2 * | 1/2018 | Genest | E04C 1/41 | |
| 2006/0150559 | A1 * | 7/2006 | Haener | E04B 2/44 | 52/606 |
| 2006/0168907 | A1 * | 8/2006 | Thorpe | E04C 1/397 | 52/309.12 |
| 2015/0368901 | A1 * | 12/2015 | Weber | E04B 2/42 | 52/220.2 |
| 2017/0145690 | A1 * | 5/2017 | Genest | E04C 1/397 | |
| 2020/0190805 | A1 * | 6/2020 | Jang | E04D 11/00 | |

FOREIGN PATENT DOCUMENTS

| | | | |
|---|---|---|---|
| CN | 202689299 | U | 1/2013 |
| CN | 103669679 | A | 3/2014 |
| CN | 104912253 | A | 9/2015 |
| TW | 423545 | | 2/2001 |
| TW | M287339 | | 2/2006 |
| TW | I604112 | B | 11/2017 |
| TW | M577036 | U | 4/2019 |

OTHER PUBLICATIONS

Taiwan Patent Office, "Search Report appended to an Office Action", which was issued to Taiwanese counterpart application No. 107145717, document of 2 pages, dated Oct. 24, 2019.

* cited by examiner

HOLLOW BRICK WITH FOOT PORTIONS

CROSS-REFERENCE TO RELATED APPLICATION

This application claims priority to Taiwanese Patent Application No. 107145721, filed on Dec. 18, 2018.

FIELD

The disclosure relates to a brick, and more particularly to a hollow brick with foot portions.

BACKGROUND

As shown in FIG. 1, an existing brick 1 includes a main body 11, and a top plate 12 that is made of porous material and that covers the main body 11. The main body 11 has a bottom wall 110, a surrounding wall 111 extending upwardly around the bottom wall 110, an inner space 100 defined by the bottom wall 110 and the surrounding wall 111, a plurality of partition plates 112 disposed in and dividing the inner space 100 into a plurality of compartment sections 101, and a plurality of spaced-apart ventilation recesses 113 indented into outer surfaces of the surrounding wall 111 and the bottom wall 110 and elongated from bottom wall 110 to a top of the surrounding wall 111.

FIG. 2 illustrates that a plurality of the existing bricks 1 are juxtaposed with each other to form a heat-insulation structure for a roof. Because the top plate 12 is porous, the juxtaposed bricks 1 may provide ventilation in a top-bottom direction through the ventilation recesses 113 between the juxtaposed bricks 1, thereby reducing accumulation of heat energy. However, ventilation along a horizontal direction is impossible for the bricks 1. As a result, heat accumulation cannot be reduced satisfactorily and heat-dissipation and heat-insulation effects cannot be efficiently achieved.

After the bricks 1 are disposed on a roof surface 119 (see FIG. 2), during rainy days, water may be accumulated in small clearances between the bottom walls 110 of the bricks 1 and the roof surface 119. Because the accumulated water in the small clearances is neither easily evaporated nor directly irradiated by sunlight, it may be an environment favorable for bacteria growth, thereby leading to a hygiene problem. Further, when the bricks 1 are in contact with the accumulated water for a long time, structural damage may result, rendering the bricks 1 unsafe for use.

SUMMARY

Therefore, an object of the disclosure is to provide a hollow brick that includes foot portions and that can alleviate at least one of the drawbacks of the prior art.

According to the disclosure, a hollow brick includes a bottom wall, two side walls, a plurality of intermediate walls, a top wall, and a plurality of ventilation holes.

The bottom wall has two opposite longitudinal sides and two opposite transverse sides connected between the longitudinal sides.

The side walls project respectively and upwardly from two opposite transverse sides of the bottom wall.

The intermediate walls project upwardly from the bottom wall between the side walls and are spaced apart along a direction parallel with the longitudinal sides of the bottom wall.

The top wall is opposite to the bottom wall and connects the side walls and the intermediate walls.

The ventilation holes are bounded by the bottom wall, the side walls, the intermediate walls and the top wall. Each of the ventilation holes has two ventilation open ends opposite to each other along a line parallel with the transverse sides of the bottom wall.

The bottom wall has a plurality of foot portions, and a plurality of bottom grooves. The foot portions project downwardly and are spaced apart from each other. Each of the bottom grooves is formed between two adjacent ones of the foot portions.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
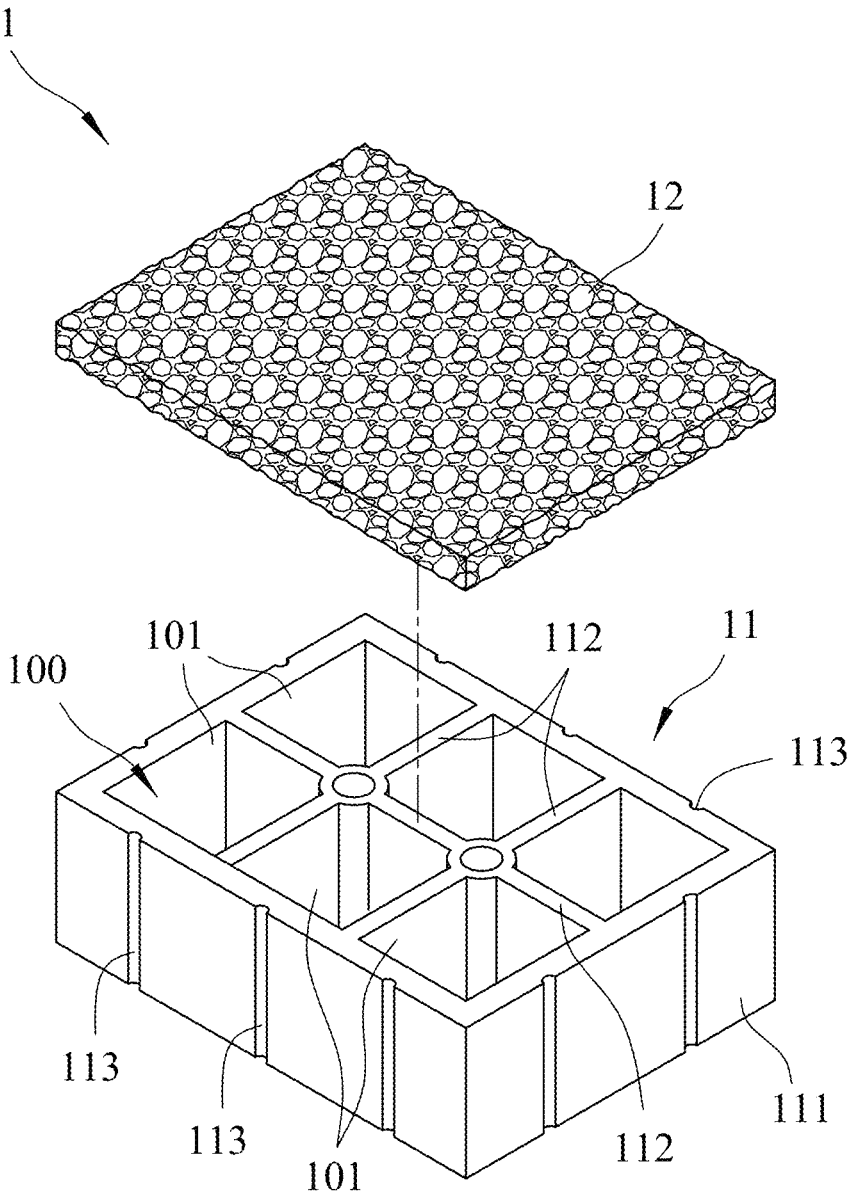
FIG.1 PRIOR ART
FIG. 1 is an exploded perspective view illustrating an existing brick.
Figure 2:
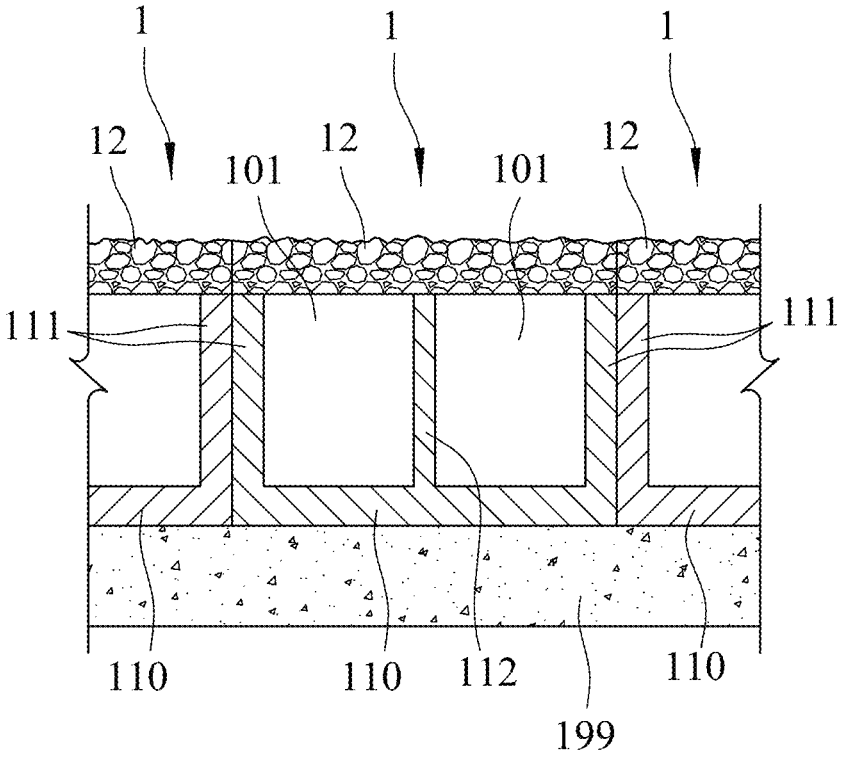
FIG.2 PRIOR ART
FIG. 2 is a fragmentary sectional view illustrating the existing bricks juxtaposed with each other.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
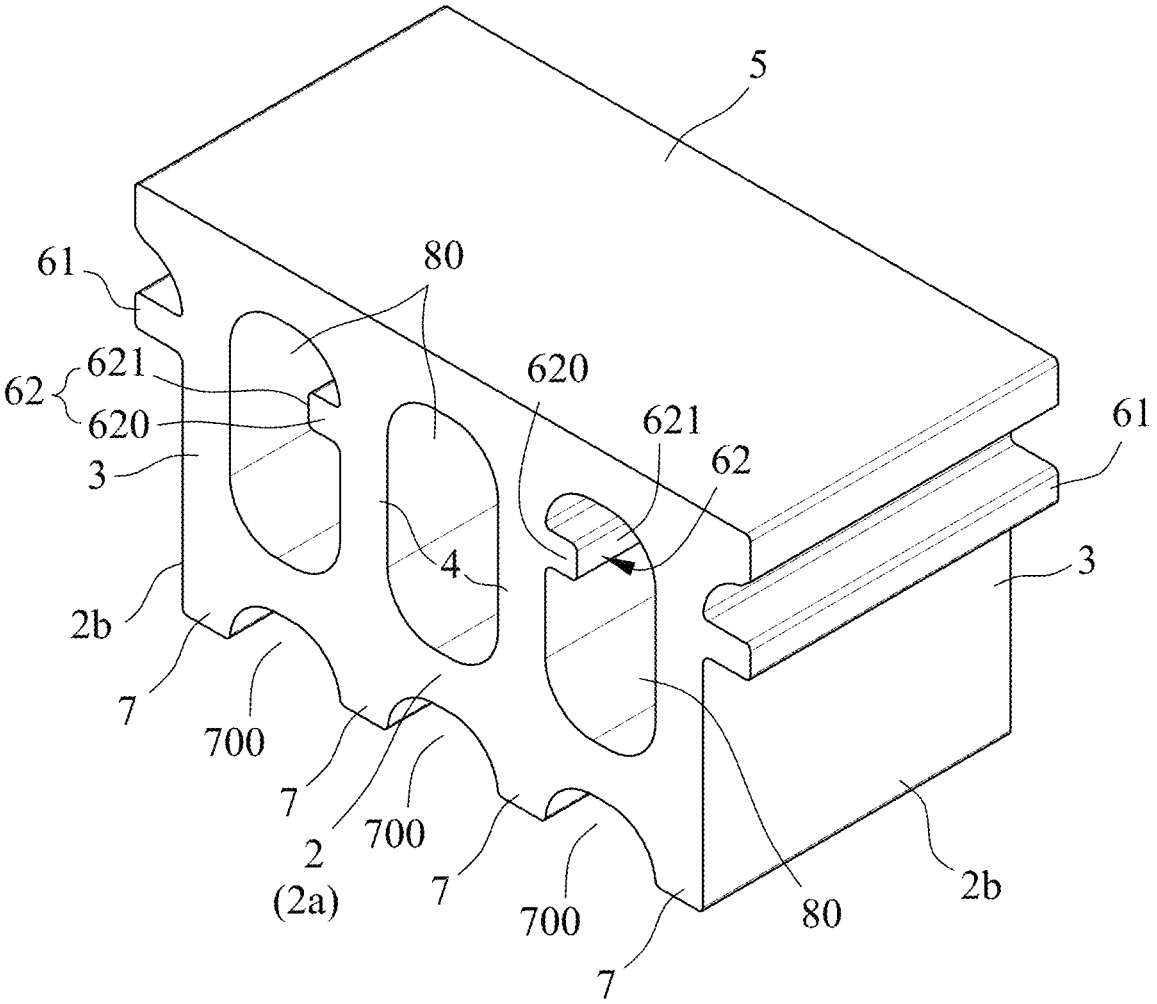
FIG. 3 is a perspective view illustrating a first embodiment of a hollow brick according to the disclosure.

FIG. 3 illustrates a first embodiment of a hollow brick according to the disclosure. The hollow brick includes a bottom wall 2, two side walls 3, two intermediate walls 4, a top wall 5, three ventilation holes 80, two outer holding ribs 61, and two inner holding ribs 62. The bottom wall 2 has a plurality of foot portions 7, and a plurality of bottom grooves 700.

The bottom wall 2 has two opposite longitudinal sides 2*a* (only one shown in FIG. 3) and two opposite transverse sides 2*b* connected between the longitudinal sides 2*a*.

The side walls 3 project respectively and upwardly from the two opposite transverse sides 2*b* of the bottom wall 2.

The intermediate walls 4 project upwardly from the bottom wall 2 between the side walls 3 and are spaced apart along a direction parallel with the longitudinal sides 2*a* of the bottom wall 2.

The top wall 5 is opposite to the bottom wall 2 and connects the side walls 3 and the intermediate walls 4.

The three ventilation holes 80 is bounded by the bottom wall 2, the side walls 3, the intermediate walls 4 and the top wall 5. Each of the ventilation holes 80 has two ventilation open ends opposite to each other along a line parallel with the transverse sides 2*b* of the bottom wall 2.

The two outer holding ribs 61 project respectively from outer surfaces of the side walls 3 in opposite outward directions.

The two inner holding ribs 62 are respectively disposed in two of the ventilation holes 80 respectively proximal to the side walls 3. Each of the inner holding ribs 62 projects from one of the intermediate walls 4 toward an adjacent one of the side walls 3. Each of the inner holding ribs 62 has a joining end 620 fixed to the corresponding one of the intermediate walls 4, and a free end 621 opposite to the joining end 620 and spaced apart from the adjacent one of the side walls 3.

The foot portions 7 of the bottom wall 2 project downwardly and are spaced apart from each other. Each bottom groove 700 is formed between two adjacent ones of the foot portions 7. In this embodiment, the number of the foot portions is four, and the number of the bottom grooves 700 is three. Because the three ventilation holes 80 and the three bottom groves 700 extend along the line parallel with the transverse sides 2*b* of the bottom wall 2, the hollow brick provides six ventilation channels along the line parallel with the transverse sides 2*b* of the bottom wall 2. However, the numbers of the intermediate walls 4, the ventilation holes 80, the foot portions 7 and the bottom grooves 700 may be varied and are not limited to this embodiment.

Figure 4:
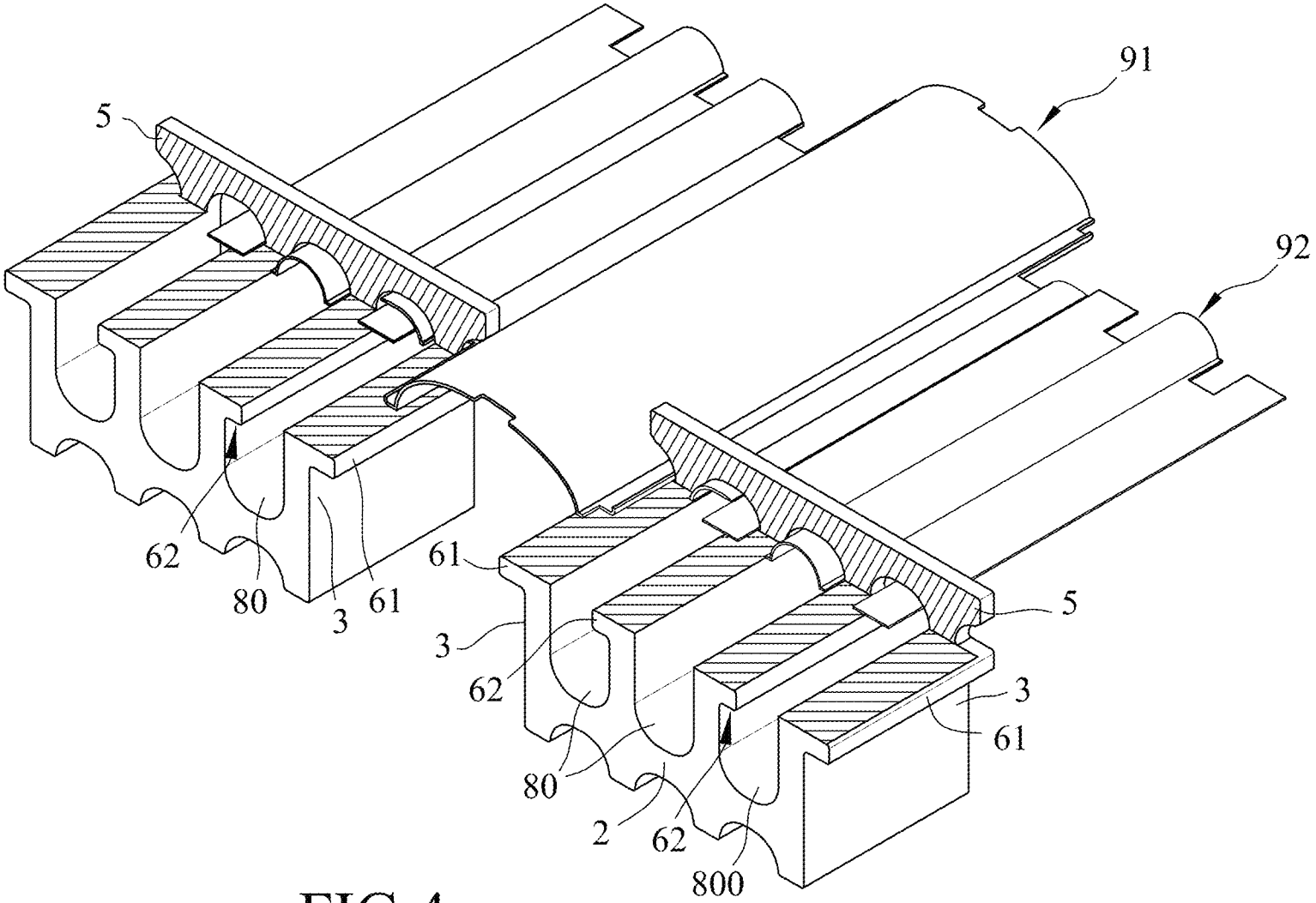
FIG. 4 is a partly sectional perspective view illustrating two adjacent hollow bricks assembled with first and second corrugated plates.
Figure 5:
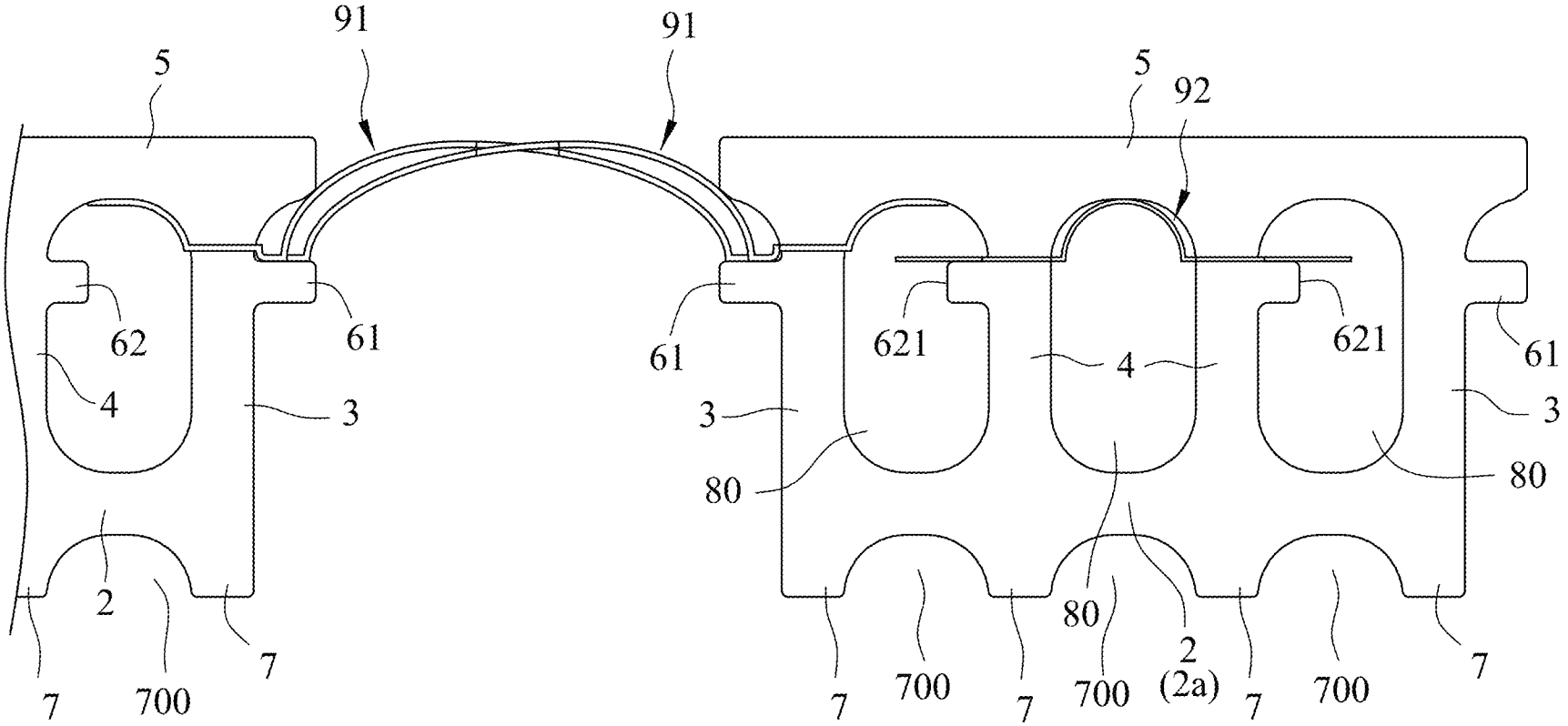
FIG. 5 is a fragmentary front view of the assembly shown in FIG. 4.
Figure 6:
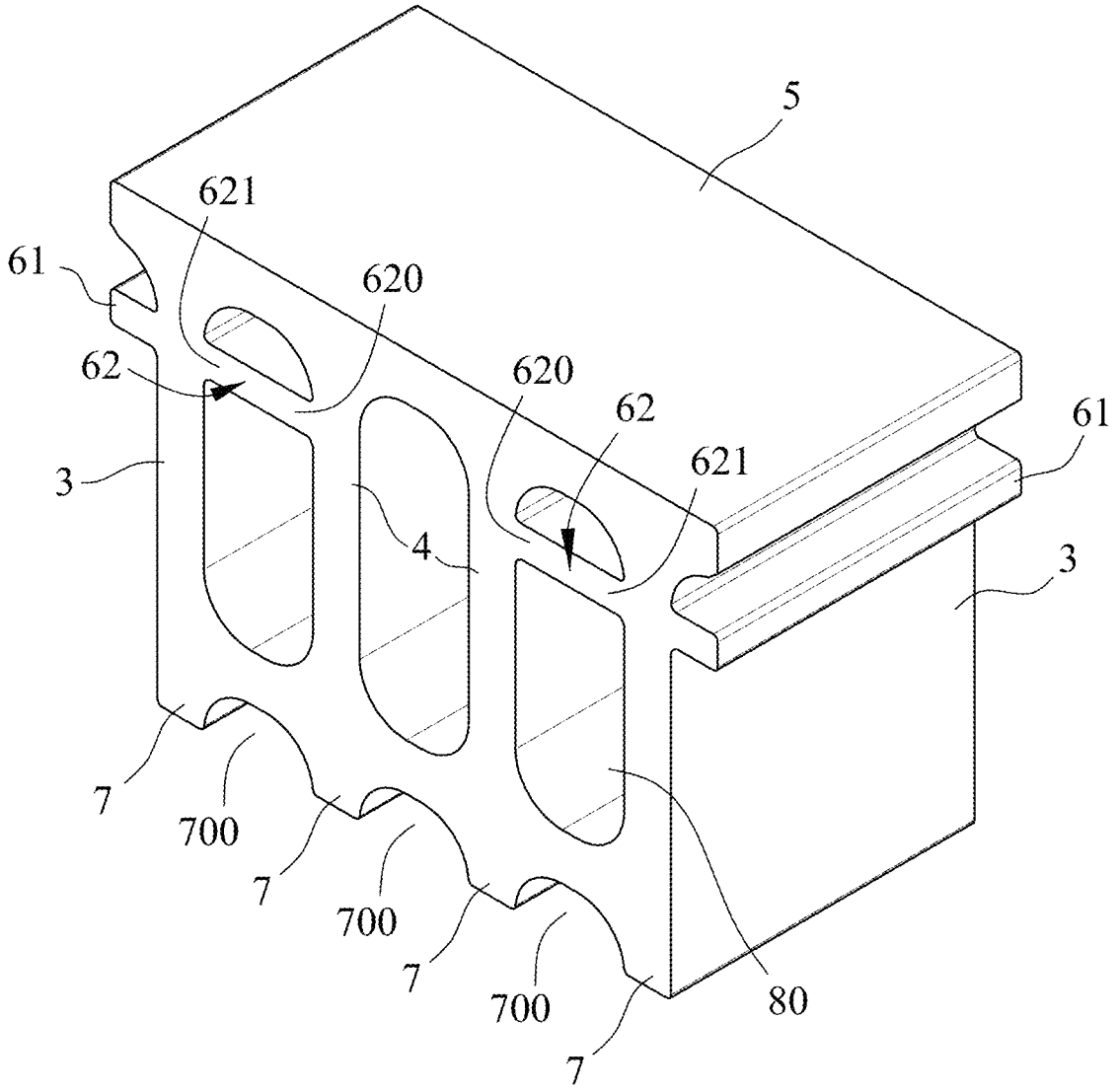
FIG. 6 is a perspective view of a second embodiment of a hollow brick according to the disclosure.

As shown in FIGS. 4 and 5, in combination with FIG. 3, a plurality of the hollow bricks of the disclosure (only two are shown in FIGS. 4 and 5) may be assembled with first and second corrugated plates 91 and 92 which are made of plastic. Two left and right ends of the corrugated plate 91 are respectively supported by the outer holding ribs 61 of two adjacent hollow bricks and are partially and respectively inserted into the ventilations 80 of the hollow bricks. The first corrugated plate 91 is therefore positioned between the two hollow bricks respectively disposed at the left and right thereof. A front end of the second corrugated plate 92 is inserted into the ventilation holes 80 and supported by the inner holding ribs 62 of the hollow brick disposed at the front side thereof. Similarly, a rear end of the second corrugated plate 92 is to be inserted into the ventilation holes 80 of another hollow brick (not shown) disposed at the rear side thereof. Therefore, two adjacent hollow bricks respectively disposed at the front and rear of the second corrugated plate 92 may be interconnected. By using a plurality of the first and second corrugated plates 91, 92, a plurality of the hollow bricks can be arranged in intersection rows to form a ventilation and temperature-adjustment structure on a roof.

The ventilation and temperature-adjustment structure composed of intersecting rows of the hollow bricks interconnected by the first and second corrugated plates 91, 92 provides ventilation not only through the three ventilation holes 80 and the three bottom grooves 700, but also through intersecting gaps each formed between rows. Therefore, ventilation is allowed in multiple directions. Further, because the bottom wall 2 has the foot portions 7 and the bottom grooves 700, water accumulation between the bottom wall 2 and the roof surface may be reduced or even eliminated. By virtue of the bottom grooves 700 for ventilation, moisture can evaporate from clearances between the bottom wall 2 and the roof surface, thereby reducing accumulated water.

FIG. 5 illustrates a second embodiment of a hollow brick of the disclosure, which has a structure generally similar to that of the first embodiment. However, in this embodiment, each of the inner holding ribs 62 has two joining ends 620 respectively fixed to one of the intermediate walls 4 and an adjacent one of the side walls 3. In other words, each inner holding rib 62 bridges one of the intermediate walls 4 and the adjacent one of the side walls 3 in one of the ventilation holes 80. Therefore, the hollow brick is structurally strengthened. Further in this embodiment, a ratio of the height of the side walls 3 and the intermediates walls 4 to the width of the hollow brick is adjusted to be increased. As such, the size of the ventilation holes 80 may be adjusted, and the height of the top wall 5 from the roof surface may be increased so as to match with the height of a surrounding wall of a building (e.g., a parapet wall) for providing suitable air entrance conditions. Therefore, a sufficient level of ventilation can be ensured, and heat dissipating and insulating effects can be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hollow brick configured to be assembled with a plastic corrugated plate, the hollow brick comprising:

a bottom wall having two opposite longitudinal sides and two opposite transverse sides connected between said longitudinal sides;

two side walls projecting respectively and upwardly from the two opposite transverse sides of said bottom wall;

a plurality of intermediate walls projecting upwardly from said bottom wall between said side walls and spaced apart along a direction parallel with said longitudinal sides of said bottom wall;

a top wall opposite to said bottom wall and connecting said side walls and said intermediate walls;

a plurality of ventilation holes bounded by said bottom wall, said side walls, said intermediate walls and said top wall, each of said ventilation holes having two ventilation open ends opposite to each other along a line parallel with said transverse sides of said bottom wall;

said bottom wall having a plurality of foot portions projecting downwardly and spaced apart from each other, and a plurality of bottom grooves, each of said bottom grooves located between two adjacent ones of said foot portions;

wherein a central axial line of each of said foot portions is collinearly aligned with a central axial line of one of said side walls and said intermediate walls;

wherein said hollow brick further includes two outer holding ribs projecting respectively from outer surfaces of said side walls in opposite outward directions; and wherein each of said outer holding ribs has a top flat surface facing upwardly configured to support a respective part of the corrugated plate, each said top flat surface and one of said outer surfaces of said side walls defining a limiting corner having an angle of not larger than 90 degrees.

2. The hollow brick as claimed in claim 1, wherein the number of said intermediate walls is two, the number of said ventilation holes is three.

3. The hollow brick as claimed in claim 1, wherein the number of said foot portions is four.

4. The hollow brick as claimed in claim 1, further comprising two inner holding ribs respectively disposed in two of said ventilation holes respectively proximal to said side walls, each of said inner holding ribs projecting from one of said intermediate walls toward an adjacent one of said side walls.

5. The hollow brick as claimed in claim 4, wherein each of said inner holding ribs has a joining end fixed to said one of said intermediate walls, and a free end opposite to said joining end and spaced apart from said adjacent one of said side walls.

6. The hollow brick as claimed in claim 4, wherein each of said inner holding ribs has two joining ends respectively fixed to said one of said intermediate walls and said adjacent one of said side walls.

* * * * *